US010577240B2

(12) United States Patent
Wu

(10) Patent No.: US 10,577,240 B2
(45) Date of Patent: Mar. 3, 2020

(54) AUTOMATIC BAGGED SPRING PRODUCTION APPARATUS

(71) Applicant: Macao Commercial & Industrial Spring Mattress Manufacturer Macao TAIWA Machinery, Andar (MO)

(72) Inventor: Wa Hoi Wu, Andar (MO)

(73) Assignee: Macao Commercial & Industrial Spring Mattress Manufacturer Macao TAIWA Machinery, Andar (MO)

( * ) Notice: Subject to any disclaimer, the term of this patent is extended or adjusted under 35 U.S.C. 154(b) by 396 days.

(21) Appl. No.: 15/488,833

(22) Filed: Apr. 17, 2017

(65) Prior Publication Data

US 2018/0297833 A1 Oct. 18, 2018

(51) Int. Cl.

| | |
|---|---|
| ***B68G 9/00*** | (2006.01) |
| ***B21F 3/02*** | (2006.01) |
| ***B21F 33/04*** | (2006.01) |
| ***B21F 27/16*** | (2006.01) |

(52) U.S. Cl.

CPC ..... *B68G 9/00* (2013.01); *B21F 27/16* (2013.01); *B21F 33/04* (2013.01)

(58) Field of Classification Search

CPC ..... B68G 9/00; B68G 2009/005; B21F 27/16; B21F 33/04

USPC ..... 29/33 E; 53/114

See application file for complete search history.

(56) References Cited

U.S. PATENT DOCUMENTS

| | | | | | |
|---|---|---|---|---|---|
| 1,566,068 | A | * | 12/1925 | Brundage | B68G 9/00 53/114 |
| 1,733,660 | A | * | 10/1929 | Gail | B21F 33/04 112/470.27 |
| 1,995,641 | A | * | 3/1935 | Kaiser | B68G 9/00 53/114 |
| 2,032,510 | A | * | 3/1936 | Spuhl | B68G 9/00 53/114 |
| 2,113,457 | A | * | 4/1938 | Zeier | B68G 9/00 112/470.27 |
| 2,430,098 | A | * | 11/1947 | Binch | B68G 9/00 340/870.29 |

(Continued)

FOREIGN PATENT DOCUMENTS

| | | |
|---|---|---|
| CN | 203508887 | 4/2014 |
| CN | 203513267 | 4/2014 |

(Continued)

*Primary Examiner* — Nathaniel C Chukwurah
*Assistant Examiner* — Lucas E. A. Palmer
(74) *Attorney, Agent, or Firm* — Welsh Flaxman & Gitler LLC

(57) ABSTRACT

An automatic bagged spring production apparatus comprising a spring treatment assembly including first and second treatment subassemblies, a spring bagging assembly, and a spring welding assembly. The first treatment subassembly includes a first longitudinally axis representing a direction of travel for springs being transported and processed and the second treatment subassembly includes a second longitudinal axis representing a direction of travel for springs being transported and processed, the first longitudinal axis and second longitudinal axis are oriented at an angle relative to each other. The automatic bagged spring production apparatus also includes an apparatus housing in which the spring treatment assembly, the spring bagging assembly and the spring welding assembly are positioned.

11 Claims, 7 Drawing Sheets

(56) References Cited

U.S. PATENT DOCUMENTS 4,131,505 A 12/1978 Davis
4,218,815 A 8/1980 Cumming
5,740,597 A * 4/1998 Eto ..... B68G 9/00 29/33 E
6,119,322 A * 9/2000 Eto ..... B21F 33/04 29/33 E
6,170,807 B1 * 1/2001 Eto ..... A47C 27/062 267/103
6,269,936 B1 * 8/2001 Schnutt ..... B21F 33/04 198/470.1
6,922,895 B1 * 8/2005 Whitworth ..... B21F 33/04 29/33 F
8,402,642 B2 * 3/2013 Kujuro ..... B68G 9/00 156/264
2002/0011698 A1 * 1/2002 Zysman ..... B68G 9/00 267/89
2006/0225842 A1 * 10/2006 Darcy, III ..... B29C 65/08 156/580.1
2008/0209731 A1 * 9/2008 Champaigne ..... B21F 35/00 29/896.9
2010/0021993 A1 * 1/2010 Wang ..... B01L 3/50853 435/286.1
2011/0247383 A1 * 10/2011 Whitworth ..... B21F 3/02 72/54
2012/0210676 A1 * 8/2012 Spinks ..... B68G 9/00 53/438
2012/0275895 A1 * 11/2012 Graf ..... B21F 35/00 414/749.1
2014/0318081 A1 * 10/2014 Knopfel ..... B68G 9/00 53/450
2016/0311010 A1 * 10/2016 Liechti ..... B65G 47/92
2017/0036393 A1 * 2/2017 Ishii ..... B29C 65/08

FOREIGN PATENT DOCUMENTS

CN 103878272 A 6/2014
CN 104259350 A 1/2015

* cited by examiner

AUTOMATIC BAGGED SPRING PRODUCTION APPARATUS

BACKGROUND OF THE INVENTION

1. Field of the Invention

The present invention generally relates to an apparatus and method for the manufacture of mattress springs. In particular, the present invention relates to automatic bagged spring production apparatus.

2. Description of the Related Art

Currently available bagged spring production equipment is limited in its ability to process a high volume of springs within a limited timeframe and a limited factory footprint. The present automatic bagged spring production apparatus overcomes these shortcomings.

SUMMARY OF THE INVENTION

It is, therefore, an object of the present invention to provide an automatic bagged spring production apparatus including a spring treatment assembly having first and second treatment subassemblies, wherein the first treatment subassembly includes a first longitudinally axis representing a direction of travel for springs being transported and processed and the second treatment subassembly includes a second longitudinal axis representing a direction of travel for springs being transported and processed. The first longitudinal axis and second longitudinal axis are oriented at an angle relative to each other. The automatic bagged spring production apparatus also includes a spring bagging assembly, a spring welding assembly, and an apparatus housing in which the spring treatment assembly, the spring bagging assembly and the spring welding assembly are positioned.

It is also an object of the present invention to provide an automatic bagged spring production apparatus including an automatic spring fabrication and coiling machine.

It is another an object of the present invention to provide an automatic bagged spring production apparatus wherein the first longitudinal axis and second longitudinal axis are oriented at an angle of approximately 60° to approximately 140°.

It is a further object of the present invention to provide an automatic bagged spring production apparatus wherein the first longitudinal axis and second longitudinal axis are oriented at an angle of approximately 90°.

It is also an object of the present invention to provide an automatic bagged spring production apparatus a plurality of fans positioned adjacent to the first treatment subassembly and a plurality of fans positioned adjacent to the second treatment subassembly.

It is another object of the present invention to provide an automatic bagged spring production apparatus wherein the plurality of the fans positioned adjacent to the first treatment subassembly and the plurality of fans positioned adjacent to the second treatment subassembly oriented to direct cooling air onto springs as the springs are moved along the spring treatment assembly.

It is a further object of the present invention to provide an automatic bagged spring production apparatus wherein the plurality of the fans positioned adjacent to the first treatment subassembly and the plurality of fans positioned adjacent to the second treatment subassembly are supported by framework of the housing structure.

It is also an object of the present invention to provide an automatic bagged spring production apparatus wherein the spring welding assembly includes a longitudinal welding tool seat with double horns.

It is another object of the present invention to provide an automatic bagged spring production apparatus wherein the double horns are made from aluminum.

It is a further object of the present invention to provide an automatic bagged spring production apparatus wherein automatic bagged spring production apparatus cools and tempers springs in a controlled manner from a temperature of 130° C. to a temperature of 60° C.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
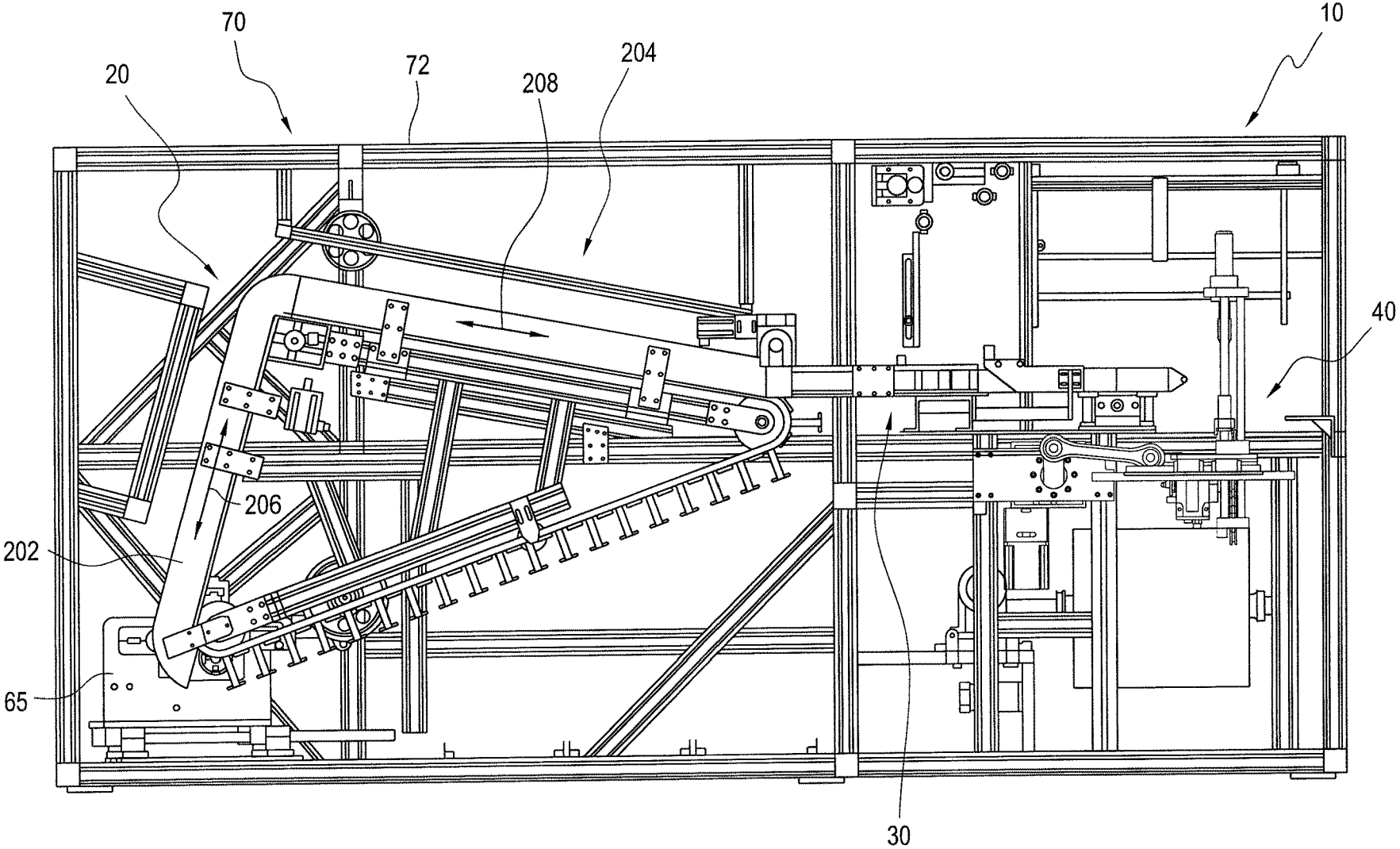
FIG. 1 is a side view of the automatic bagged spring production apparatus in accordance with the present invention.
Figure 2:
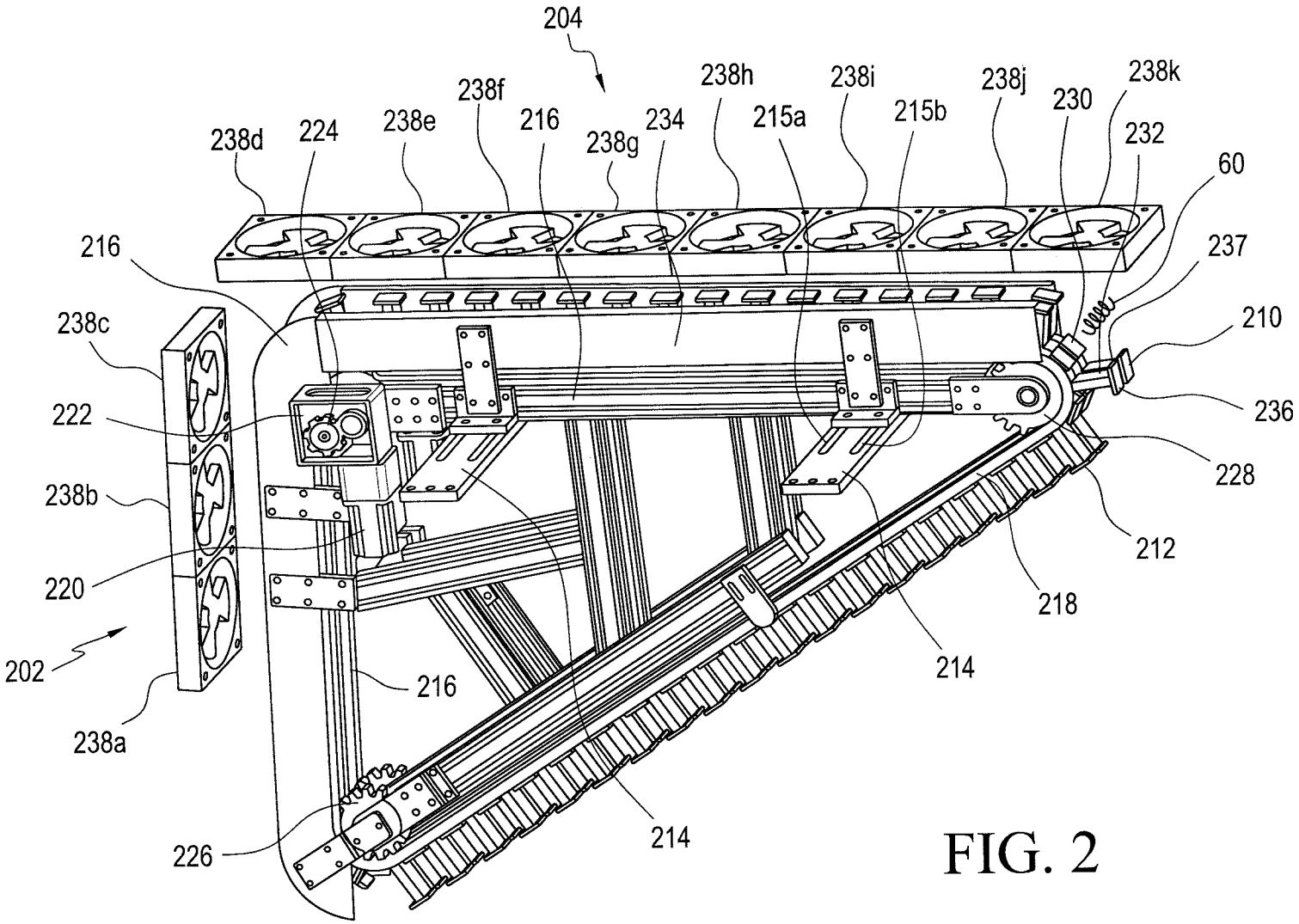
FIG. 2 is a perspective view of the spring treatment assembly.
Figure 3:
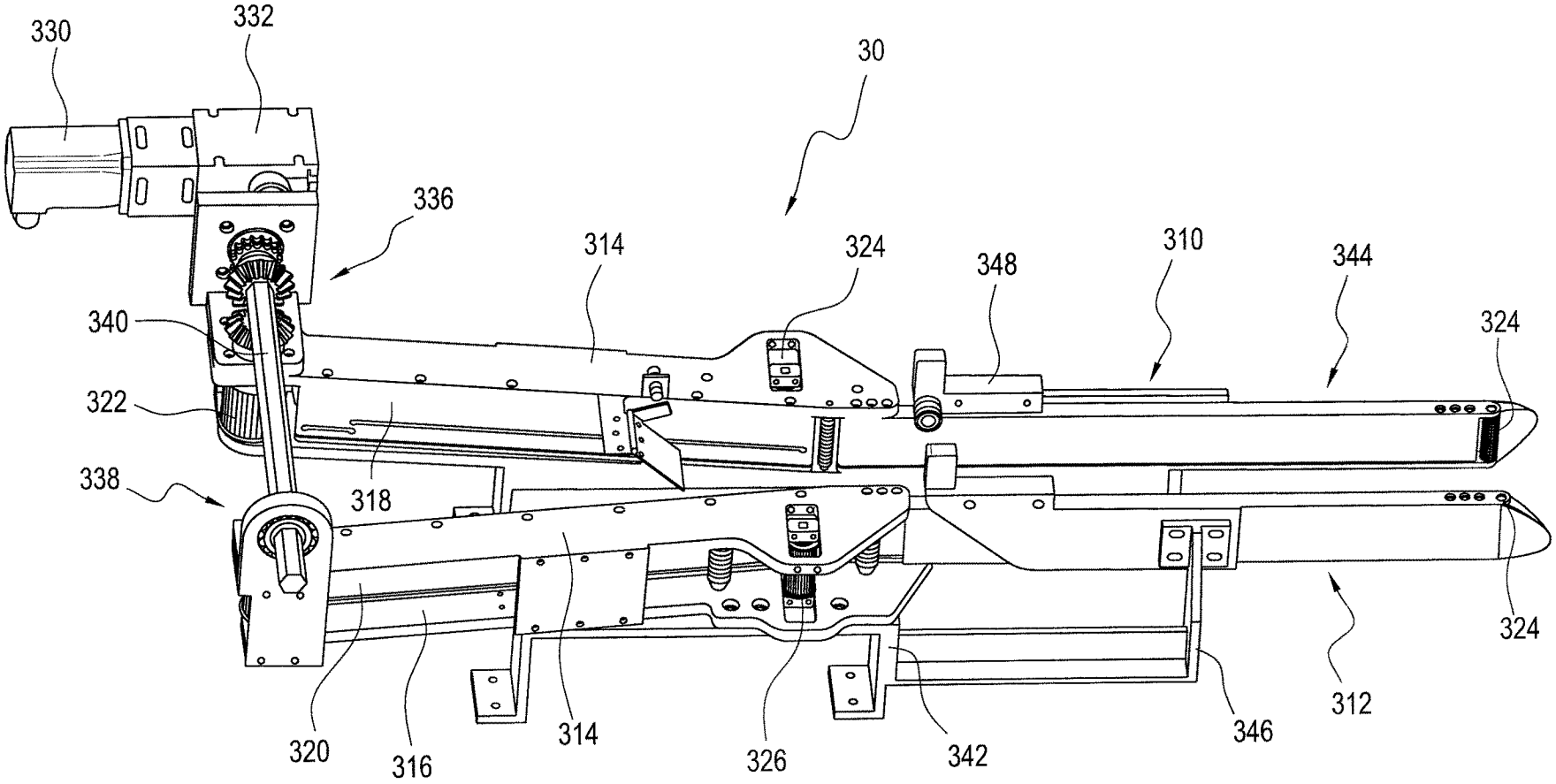
FIG. 3 is a perspective view of the spring bagging assembly without the belts, springs and fabric shown.
Figure 4:
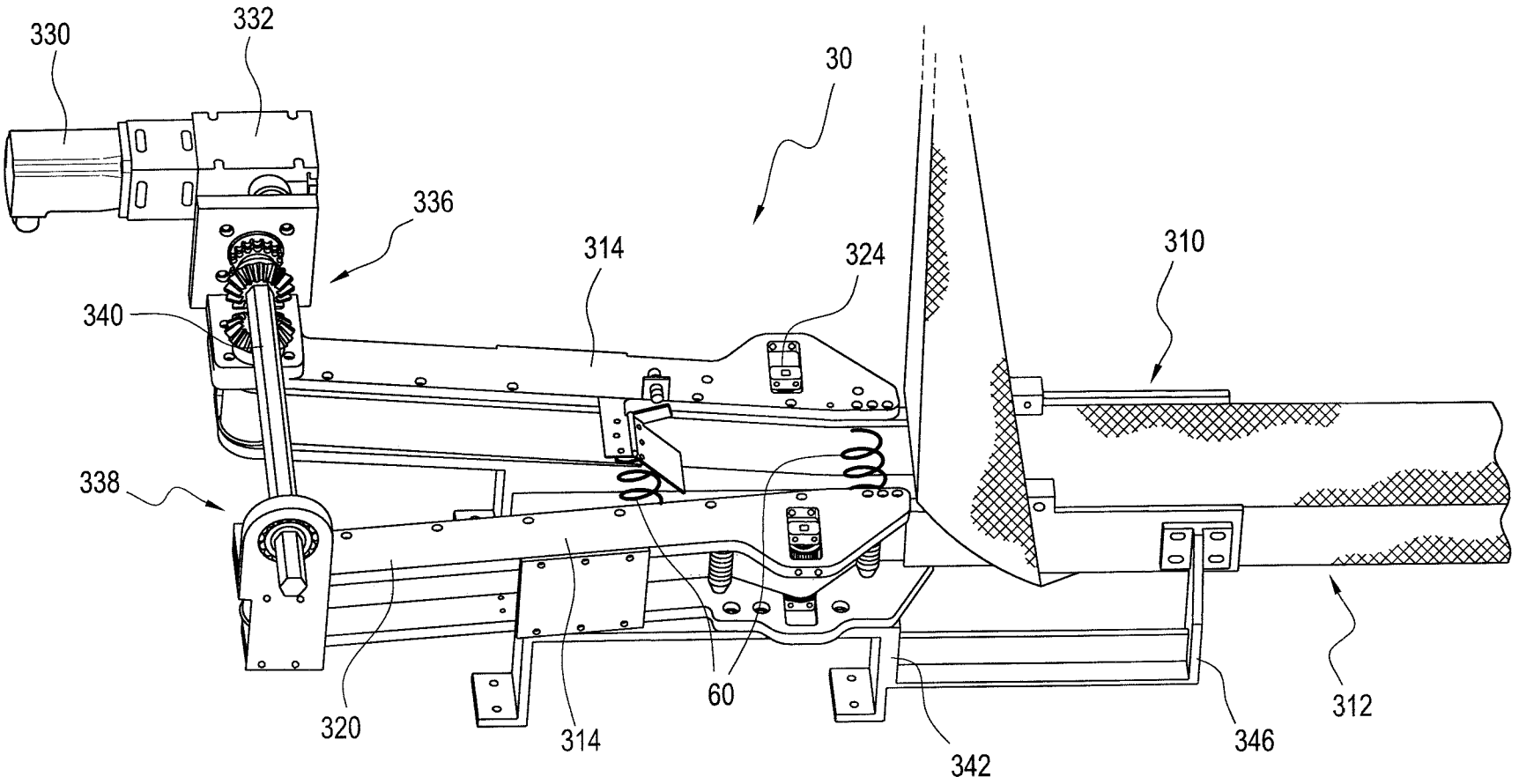
FIG. 4 is a perspective view of the spring bagging assembly.
Figure 5:
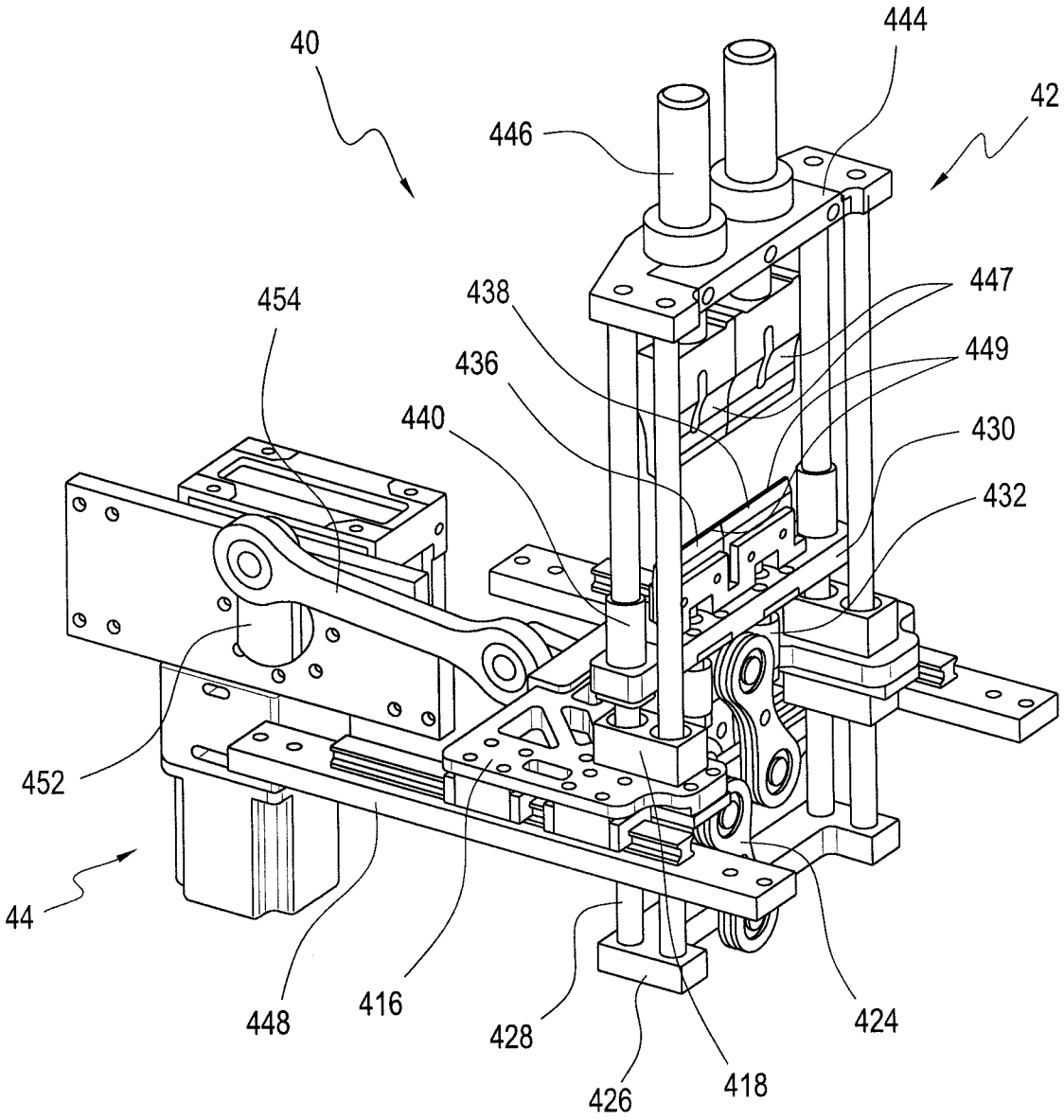
FIG. 5 is a perspective view of the spring welding assembly.
Figure 6:
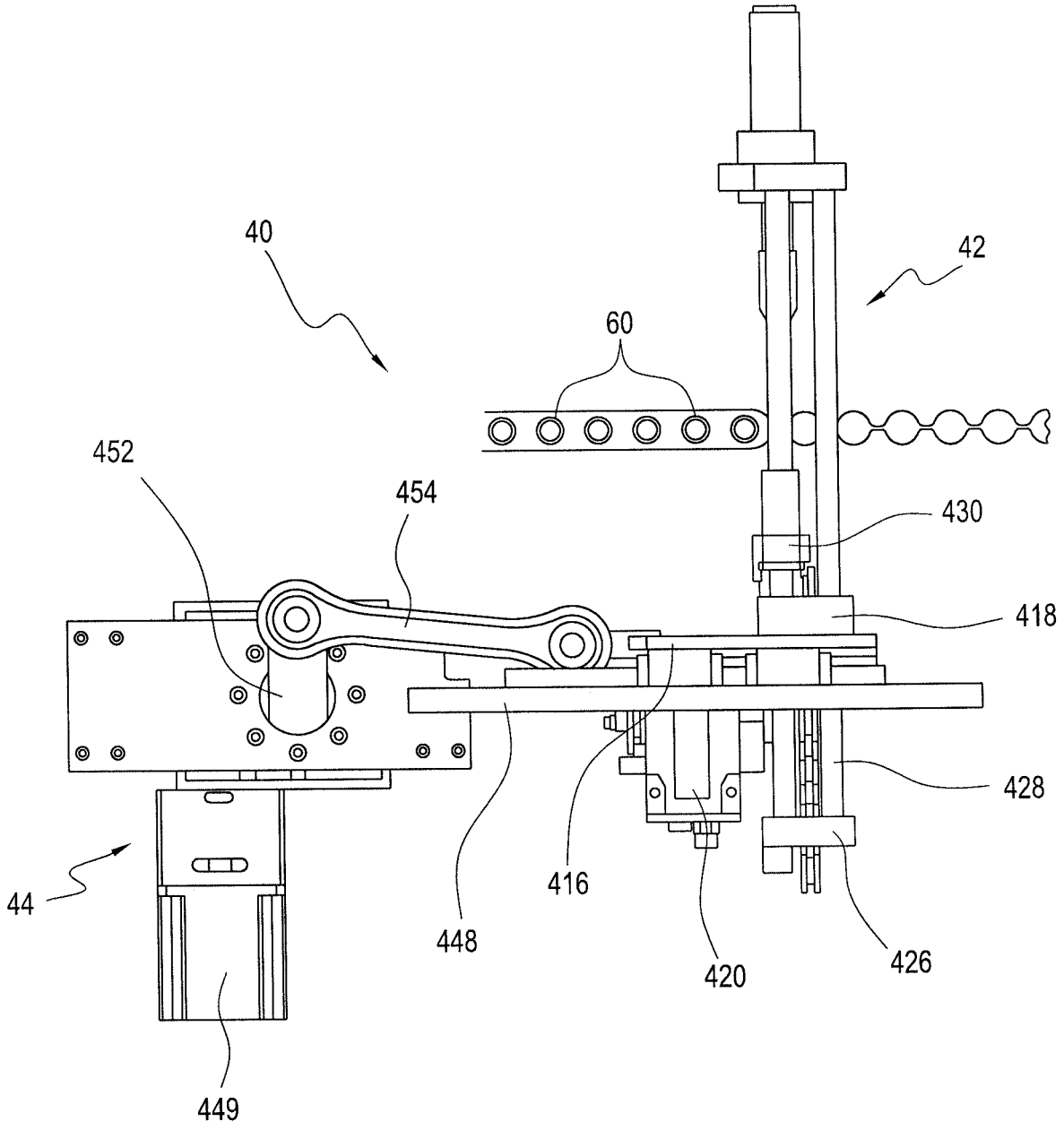
FIG. 6 is a side view of the spring welding assembly.
Figure 7:
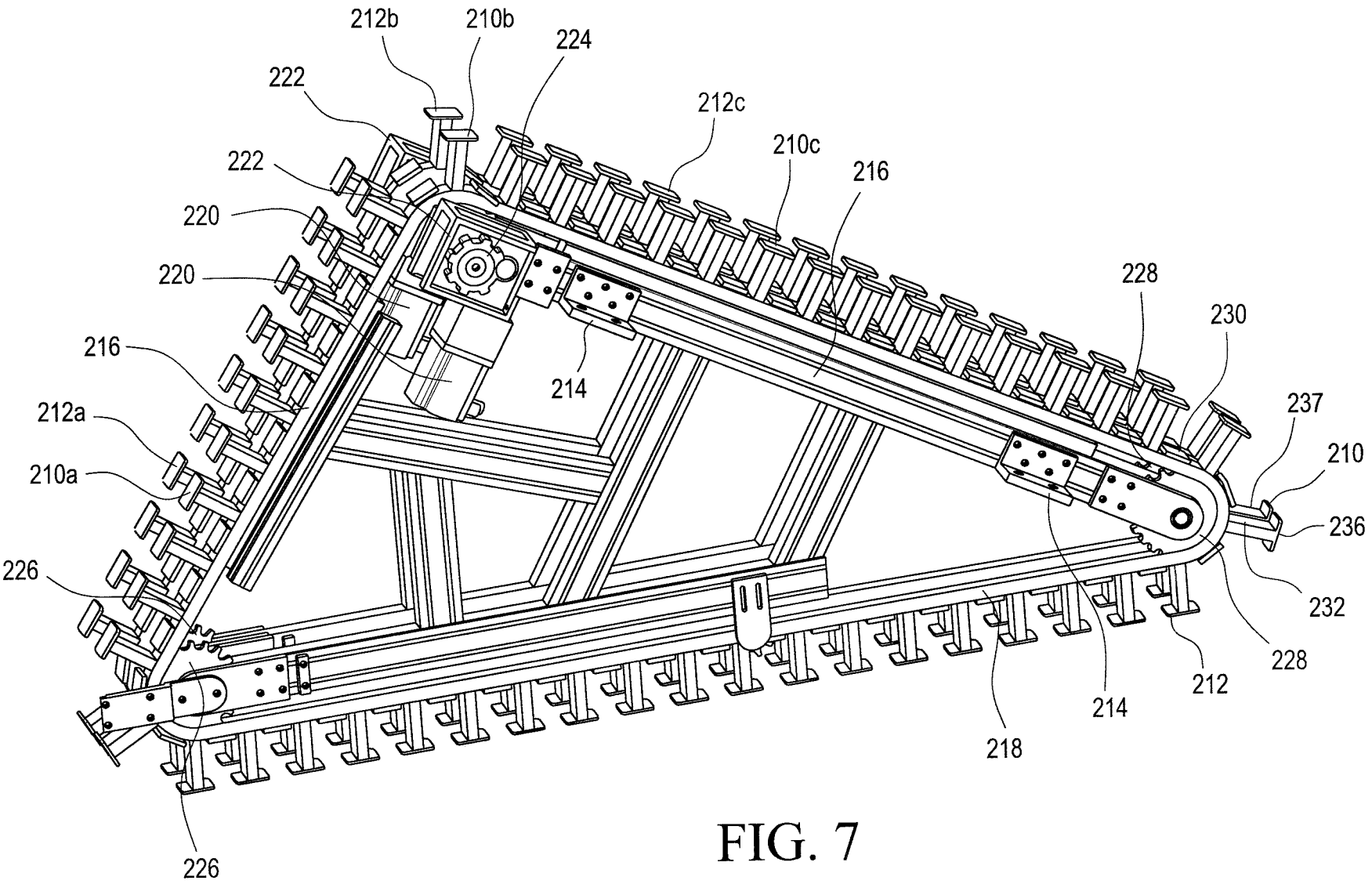
FIG. 7 is a detail perspective view of the first and second chain components.

The present invention provides an automatic bagged spring production apparatus 10 which is greatly enhances the ability for the cooling of springs in a limited space while simultaneously optimizing the working efficiency. As shown in FIGS. 1 to 6, the automatic bagged spring production apparatus 10 is composed of a spring treatment assembly 20, a spring bagging assembly 30 and a spring welding assembly 40. The spring treatment assembly 20, spring bagging assembly 30 and spring welding assembly 40 are connected in sequence.

The springs 60 produced by the automatic bagged spring production apparatus 10 are tempered and conveyed through the spring treatment assembly 20. They then enter into the spring bagging assembly 30 to be bagged. Finally, the bagged springs are welded and moved through the spring welding assembly 40. The entire automatic bagged spring production apparatus 10 is housed with an apparatus housing 70 that includes a housing framework 72. While only a few springs are shown in the various drawings, it is appreciated the entire automatic bagged spring production apparatus 10 will be loaded with springs 60 to the extent permitted by operation of thereof.

The springs 60, which are produced by an automatic spring fabrication and coiling machine 65 enter into the spring treatment assembly 20 directly from the automatic spring fabrication and coiling machine 65. Spring fabrication machines are well known in the art and produce springs via an extrusion process.

Once the springs 60 are fabricated, they are transferred to the spring treatment assembly 20 where they are cooled and tempered in a controlled manner from a temperature of 130° C. to a temperature of 60° C. (as the springs 60 exit the spring bagging assembly 30). The spring treatment assembly 20 includes first and second treatment subassemblies 202, 204. Each of the first and second treatment subassemblies 202, 204 includes a longitudinally extending structure. As such, the first treatment subassembly 202 includes a first longitudinally axis 206 representing the direction of travel for springs 60 being transported and processed in accordance with the present invention and the second treatment subassembly 204 includes a second longitudinal axis 208 representing the direction of travel for springs 60 being transported and processed in accordance with the present invention. The first and second longitudinal axes 206, 208 are oriented at an angle relative to each other. In accordance with a preferred embodiment, the first and second longitudinal axes 206, 208 are oriented at an angle of from 60° to 140°, preferably an angle of 90°.

The spring treatment assembly 20 includes first and second groups of chain components 210, 212. The first and second groups of chain components 210, 212 extend through the first and second treatment subassemblies 202, 204 in a continuous manner and allow for the continuous transport of springs 60 through the first and second treatment subassemblies 202, 204 and ultimately to the spring bagging assembly 30 where the springs 60 are bagged in a manner that will be explained below in greater detail.

The two groups of chain components 210, 212 are installed on support plates 214. The support plates 214 are provided with two strip through-hole grooves 215*a*, 215*b*. The first group of chain components 210 is fixed at one end of the installation plate 214, while the second group of chain components 212 is adjusted freely along the strip through-hole grooves 215*a*, 215*b* according to the height of spring 60.

Each of the first and second chain components 210, 212 includes a chain bracket 216, a continuous chain 218, a speed reducer 222, a driving wheel 224, first and second driven wheels 226, 228, a spring supporting plate 230, a spring pushing plate 232, a spring block plate 234, and a cover plate 236. The spring pusher plate 232 and the spring cover plate 236 are integrally formed as a T-shaped spring retention assembly 237 that holds springs 60 in position in accordance with the present invention as discussed below in greater detail. The first and second chain components 210, 212 are driven by respective servo motors 220.

The driving wheels 224 and the driven wheels 226, 228 are installed at various locations along the length of the chain brackets 216. In accordance with a preferred embodiment, each of the first and second chain components 210, 212 includes a first end 210*a*, 212*a* at the first end 202*a* of the first treatment subassembly 202, a central section 210*b*, 212*b* where the first and second chain components 210, 212 transition from the first treatment subassembly 202 to the second treatment subassembly 204, and a second end 210*c*, 212*c* at the second end 212*b* of the second treatment subassembly 204. With this in mind, the driven wheels 226 of the first and second chain components 210, 212 are positioned at the first ends 210*a*, 212*a*, the driving wheels 224 of the first and second chain components 210, 212 are positioned at the central sections 210*b*, 212*b* of the respective first and second chain components 210, 212, and the driven wheels 228 are positioned at the second ends 210*c*, 212*c* of the respective first and second chain components 210, 212.

The servo motor 220 and speed reducer 222 are connected with the driving wheels 224 and installed on the chain brackets 216. The chains 218 are installed around the respective driving wheels 224 and the driven wheels 226, 228.

The spring supporting plates 230 are installed on the chains 218 horizontally. The spring retention assemblies 237 are secured to the chains 218 such that the spring pushing plates 232 are oriented normal to the chains 218 and the spring cover plates 236 are oriented parallel to the chains 218. In particular, the spring pushing plates 232 are directly secured to the chains 218 such that the longitudinal axis of the spring pushing plates 232 are substantially perpendicular to the direction of travel for the chains 218 and then the cover plates 236 are installed on the spring pushing plates 232 such that the cover plates 236 lie in a plane that is substantially perpendicular to the plane in which the spring pushing plates 232 lie. The spring block plates 234 are arranged on the lateral side of the chain brackets 216. Thus, the spring supporting plates 230, the spring pushing plates 232, the cover plates 236 and the spring block plates 234 form a cavity in which the springs 60 are positioned as they are conveyed along the spring treatment assembly 20 in accordance with the present invention.

The servo motors 220 drive the driving wheels 224, the driven wheels 226, 228 and the chains 218 to rotate through the speed reducers 222. The spring supporting plates 230 support the springs 60. The spring block plates 234 block two ends of the springs 60. The spring pushing plates 232 push the springs 60 to be conveyed forward.

Positioned above the first and second chain components 210, 212 and forming part of the first and second treatment subassemblies 202, 204 are a plurality of a fans 238*a-k* oriented to direct cooling air onto the springs 60 as they are moved along the spring treatment assembly 20 and to the spring bagging assembly 30. In accordance with a preferred embodiment three fans 238*a-c* are positioned along the length of the first treatment subassembly 202 and eight fans 238*d-k* are positioned along the second treatment assembly 204. The fans 238*a-k* are preferably supported by the framework 72 of the housing structure 70 in which the present automatic bagged spring production apparatus 10 is positioned. In accordance with a preferred embodiment, it is desirable to have between 10 to 13 fans positioned along the first and second chain components.

With eleven fans 238*a-k* along the length of the spring treatment assembly 20 and the additional functional length provided by dividing the spring treatment assembly 20 into first and second treatment subassemblies 202, 204 angularly orienting relative to each other the present automatic bagged spring production apparatus 10 is capable of cooling the springs 60 from a temperature of 130° C. to a temperature of 60° C. before entering the spring bagging assembly 30. For example, and in accordance with a preferred embodiment, the angularly oriented first and second treatment subassemblies 202, 204 provide for a total travel distance of 3807.25 mm (that is, 800 mm for the first treatment subassembly 202, 1700 mm for the second treatment subassembly 204, and 1400 mm for the spring bagging assembly 30 all of which is able to fit within a housing having a length of from 2000 mm to 3000 mm.

After moving through the end of spring treatment assembly 20, the spring 60 enters into the spring bagging assembly 30. As will be explained below in greater detail, the spring bagging assembly 30 includes first and second synchronous belt assemblies 310, 312, a servo motor 330, a speed reducer 332, a hexagonal axel 340 and two groups of bevel gears 336, 338. The servo motor 330 drives the first and second synchronous belt assemblies 310, 312 to clamp the spring 60 to convey it forward via the speed reducer 332, the hexagonal axel 340, the bevel gears 336, 338, and the synchronous wheel 322. With this in mind, each of the first and second synchronous belt assemblies 310, 312 includes an upper protecting plate 314, a lower protecting plate 316, a front guiding plate 318, a back guiding plate 320, a driving synchronous wheel 322, a driven synchronous wheel 324, a synchronous belt elastic wheel 326 and a synchronous belt 328.

The front guiding plate 318, back guiding plate 320, driving synchronous wheel 322 and synchronous belt elastic wheel 326 are installed between the upper protecting plate 314 and lower protecting plate 316. The driven synchronous wheel 324 is installed at the end of the back guiding plate 320. The synchronous belt 328 surrounds the outside of the front and back guiding plates 318, 320 through the driving synchronous wheel 322, the driven synchronous wheel 324 and the synchronous belt elastic wheel 326.

Two ends of the spring 60 are positioned between the two synchronous belts 328. As discussed above, the synchronous belt 328 includes the servo motor 330, the speed reducer 332, the hexagonal axis 334 and two groups of bevel gears 336, 338. The servo motor 330 drives the synchronous belt 328 to clamp the spring 60 to convey the spring 60 forward via the speed reducer 332, the hexagonal axis 340, the bevel gears 336, 338, and the synchronous drive wheel 322. The bevel gears 336, 338 and the synchronous driving wheels 322 drive the synchronous belts 328 to clamp the spring 60 to convey it forward. The first and second synchronous belt assemblies 310, 312 are symmetrically installed on a support structure 342.

A transverse welding mechanism 344 is arranged at the back ends of the respective first and second synchronous belt assemblies 310, 312. The transverse welding mechanism 344 includes a folding plate bracket 346 and a folding plate 348. The folding plate 348 is positioned on the outside of the back guide plate 320 and installed on the folding plate bracket 346. The folding plate bracket 346 is installed on the support structure 342. Two sides of the nonwoven fabric 380 extend downward along the gap between the back guide plate 320 and the folding plate 348 so as to wrap the fabric 380 about the springs. The two connecting edges of the nonwoven fabric 380 are pressed together using known techniques such as disclosed in Applicant's own Chinese Patent No. 203508887, which is incorporated herein by reference.

After moving through the tail end of the spring bagging assembly 30, the spring 60, which is wrapped in the fabric 380, enters into the spring welding assembly 40. The spring welding assembly 40 includes a longitudinal welding mechanism 42 and a spring moving mechanism 44. The longitudinal welding mechanism 42 includes a main panel 416, a sliding block 418, a servo motor 420, a speed reducer 420, a camshaft 422, a connecting rod 424, a transverse plate 426, a guiding shaft 428, a longitudinal welding tool installation plate 430, a longitudinal welding tool guiding element 432, a cylinder 434, a longitudinal welding tool seat 436 with double horns 436*a*. This is a double ultrasonic system, which includes 2 horns, 2 booster and 2 converters, a longitudinal welding tool 438, a linear bearing 440, a thrust spring 442, a longitudinal ultrasonic seat 444 and a longitudinal ultrasonic tool 446 with double horns 446*a*.

The servo motor 420, the speed reducer 420 and the camshaft 422 are installed under the main panel 416. The main panel 416 is provided with sliding blocks 418 on the two sides. One end 428*a* of the guiding shaft 428 is connected with the longitudinal ultrasonic seat 444 which is arranged with the longitudinal ultrasonic tool 446. The other end 428*b* of the guiding shaft 428 is connected with the transverse plate 426. The longitudinal welding tool installation plate 430 is installed on the guiding shaft 428 through the linear bearing 440. The longitudinal welding tool seat 436 is installed on the installation plate 430. The longitudinal welding tool guiding element 432 is arranged under the longitudinal welding tool installation plate 430, and in touch with the cam of the camshaft 422.

The spring moving mechanism 44 includes a linear guide 448, a servo motor 449, a speed reducer 450, a crank shaft 452 and a connecting rod 454. The linear guide 448 is positioned under the main panel 416. One end 454*a* of the connecting rod 454 is connected with the crank shaft 452. The other end 454*b* is connected with the main panel 416. The servo motor 449 drives the crank shaft 452 to rotate through the speed reducer 450. The connecting rod 454 drives the longitudinal welding mechanism 42 to move back and forth along the linear guide 448, thus finishing the moving of the spring 60.

In operation, when the longitudinal ultrasonic tool 446 and the longitudinal welding tool 438 weld the bag (that is, the fabric 380 wrapped around the spring 60) together, the spring moving mechanism 44 pushes the longitudinal welding mechanism 42 to move forward a distance which is equal to the length of the spring 60. The longitudinal ultrasonic tool 446 and the longitudinal welding tool 438 then go back to the original positions respectively, and act several times in this manner. The longitudinal welding of the bag and moving of the spring 60 is then finished, thus producing a bagged spring.

The longitudinal ultrasonic tool 446 and the longitudinal welding tool 438 are constructed with double horns and anvils in a manner that overcomes the ultrasonic performance when the machine runs at a speed of 140 to 160 operations per minute. It is 416, 424, 426, 430, 436 444, 447, 449, and 454 that are made of aerospace aluminum. The use of such strong lightweight material allows the machine to run faster. In addition, the guiding shaft is constructed of between 20 mm to 40 mm diameter titanium which provides desirable strength and weight considerations.

The present automatic bagged spring production apparatus offers various advantages. For examples, the automatic bagged spring production apparatus has the advantage that the structure is simple and reasonable, the operation is easy, the stability is high, and the stability of the machine and the working efficiency are greatly improved under the driving of a servo motor. In the using process, all components operate and act quickly and accurately, the power consumption is low, and multiple defects of existing domestic bagged spring production equipment can be overcome in use.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. An automatic bagged spring production apparatus, comprising:

a spring treatment assembly including first and second treatment subassemblies, wherein the first treatment subassembly includes a first longitudinally axis representing a direction of travel for springs being transported and processed and the second treatment subassembly includes a second longitudinal axis representing a direction of travel for springs being transported and processed, the first longitudinal axis and second longitudinal axis are oriented at an angle relative to each other;

a spring bagging assembly;

a spring welding assembly;

an apparatus housing in which the spring treatment assembly, the spring bagging assembly and the spring welding assembly are positioned; and a plurality of fans positioned adjacent to the first treatment subassembly and a plurality of fans positioned adjacent to the second treatment subassembly.

2. The automatic bagged spring production apparatus according to claim 1, further including an automatic spring fabrication and coiling machine.

3. The automatic bagged spring production apparatus according to claim 1, wherein the first longitudinal axis and second longitudinal axis are oriented at an angle of approximately 60° to approximately 140°.

4. The automatic bagged spring production apparatus according to claim 1, wherein the first longitudinal axis and second longitudinal axis are oriented at an angle of approximately 90°.

5. The automatic bagged spring production apparatus according to claim 1, wherein the plurality of the fans positioned adjacent to the first treatment subassembly and the plurality of fans positioned adjacent to the second treatment subassembly oriented to direct cooling air onto springs as the springs are moved along the spring treatment assembly.

6. The automatic bagged spring production apparatus according to claim 1, wherein the plurality of the fans positioned adjacent to the first treatment subassembly and the plurality of fans positioned adjacent to the second treatment subassembly are supported by framework of the housing structure.

7. The automatic bagged spring production apparatus according to claim 1, wherein the spring welding assembly includes a longitudinal welding tool seat with double horns.

8. The automatic bagged spring production apparatus according to claim 1, wherein the spring welding assembly includes a longitudinal ultrasonic tool with double horns.

9. The automatic bagged spring production apparatus according to claim 8, wherein the double horns are made from aluminum.

10. The automatic bagged spring production apparatus according to claim 1, wherein automatic bagged spring production apparatus cools and tempers springs in a controlled manner from a temperature of 130° C. to a temperature of 60° C.

11. The automatic bagged spring production apparatus according to claim 10, wherein the plurality of the fans positioned adjacent to the first treatment subassembly and the plurality of fans positioned adjacent to the second treatment subassembly are oriented to direct cooling air onto springs as the springs are moved along the spring treatment assembly.

* * * * *